United States Patent [19]

Shlemon

[11] Patent Number: 4,830,695

[45] Date of Patent: May 16, 1989

[54] PROCESS FOR APPLYING PIGMENT

[76] Inventor: Raymond S. Shlemon, 2323 W. 116th Pl., Chicago, Ill. 60643

[21] Appl. No.: 120,846

[22] Filed: Nov. 16, 1987

[51] Int. Cl.[4] ..... B05D 1/32

[52] U.S. Cl. ..... 156/152; 156/249; 156/253; 427/282; 101/129

[58] Field of Search ..... 427/282; 118/505; 101/128.21, 129; 156/152, 249, 253

[56] References Cited

U.S. PATENT DOCUMENTS

| | | | |
|---|---|---|---|
| 3,810,812 | 5/1974 | Koenig | 156/249 X |
| 4,397,261 | 8/1983 | Jones | 427/282 X |
| 4,702,942 | 10/1987 | Wood | 427/282 X |

*Primary Examiner*—Evan Lawrence
*Attorney, Agent, or Firm*—Irwin C. Alter

[57] ABSTRACT

A process and article for producing finished artwork based on a previously completed professional rendering of the same image. The process uses the placement and temporary adhesion of the article an imprinted, transparent film, to a substrate work surface upon which a finished image will be applied in stages. Sections of the film are serially removed by cutting them along outlines imprinted on the film; pigment is applied to the exposed areas of the substrate; the cut sections are replaced, and new sections of film are cut and removed for the application of other pigment. The serial removal and replacement of cut film sections is performed according to an order indicated in the imprinting of the film.

14 Claims, 2 Drawing Sheets

PROCESS FOR APPLYING PIGMENT

BACKGROUND OF THE INVENTION

This invention relates to a process and article for producing finished artwork wherein pigments are selectively applied to a surface using the placement, cutting, removal and replacement of cut sections of an imprinted, transparent film. A previously completed rendering of the same image which is the desired end product of the process can be used as a guide, along with the imprinted film, to perform selective pigment application.

Prior to this time, the artistically inclined hobbyist had a limited number of devices to aid him in the rendering of the image he desired to create. Each of these devices, while of some limited use, has drawbacks, either because it too narrowly restricts the practitioner's own creative skills, or because, to the contrary, it gives him too much leeway and too little guidance in the creation of a finished and professional-like rendering.

The stencil is an example of the former type. Having rigidly pre-cut and non-removable openings, an ordinary stencil pretty much predetermines the outcome; pigment is applied to the work surface through the openings revealed by the stencil; the stencil is removed; and the pre-ordained image is left on the painting surface, with not much initiative, interest or self-satisfaction on the part of the user.

An example of the latter type of device, one which provides too little reining-in for the amateur hobbyist, is the traditional "paint-by-numbers". Unlike the stencil, which has predetermined boundaries, a typical paint-by-numbers kit has the image of the to-be-completed artwork pre-printed on the work surface, with sub-sections outlined and identified by numerals which serve as a key to the colors to be applied to the surface by the user of the kit. The lack of any masking-type function inherent in such a kit allows the practitioner to be sloppy in his application of paint, so that he may cover part of a section coded for one color with the color indicated for the contiguous section. Thus, a sloppy, non-realistic final rendering would be the result.

In addition to the drawbacks already enumerated in these two prior art hobbyist devices, neither gives specific guidance to the amateur hobbyist for the concentration of pigment to be applied in any specific sub-section, nor clues as to the direction of application, nor any other signpost for the accomplishment of subtle coloring effects which contribute to a more realistic looking end-product.

Lastly, while transparent film having an adhesive backing which is reusable, has been available for use in artwork, such film was not available with imprinting of artwork thereon, nor with imprinting of serial numbering or other indicia of how best to utilize the film in the production of a finished work.

SUMMARY OF THE INVENTION

It is therefore an object of this invention to provide an article and process for persons of varying artistic skill levels to be able to produce finished, polished-looking renderings of various images, which are patterned after existing ones.

It is another object of this invention to provide an article and process for use by persons of varying artistic skill levels to produce finished artwork wherein they may neatly color contiguous areas of a work surface with different hues and intensities, by virtue of masking the areas not receiving a given hue, while at the same time allowing them to keep the entire aimed-for image in view in outline form.

It is further an object of this invention to provide an improved use, in artwork, for removably adhesive, transparent film which includes imprinting said film with the outline of the image to be produced, and further imprinting sub-sections of the image with numeric indicators for serial removal and replacement, and further still, imprinting the film with indicia of the direction of application of pigment, whereby said film is of much greater use in the production of finished artwork than was heretofore possible.

Other and further objects, advantages and features of my invention will become more readily apparent in the following description wherein a preferred embodiment of the invention is described, especially when read in conjunction with the accompanying drawings, wherein:

DETAILED DESCRIPTION OF THE INVENTION

Figure 1:
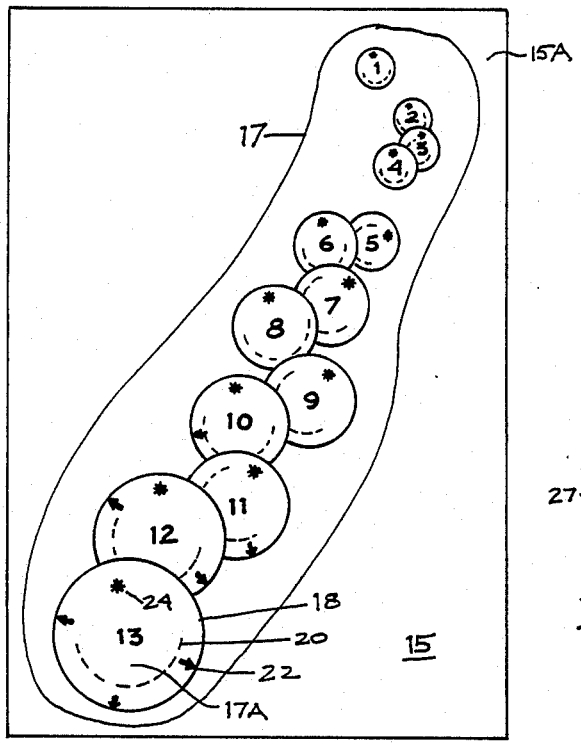
FIG. 1 is a frontal plane view of an imprinted transparent film that has an outline, drawn showing perspective, of a series of balloons.

Referring generally to the figures in the drawings, wherein like parts are indicated by corresponding numerals throughout the several views, an imprinted film 15 embodying the present invention is shown in FIG. 1. But for the imprinted areas, the film 15 is transparent 15*a*, the overall image to be reproduced is outlined on the film as a series of disks 17, representing balloons, and subdivided into the outlines of individual balloons 17*a* that are identified by the numerals "1"–"13".

Figure 2:
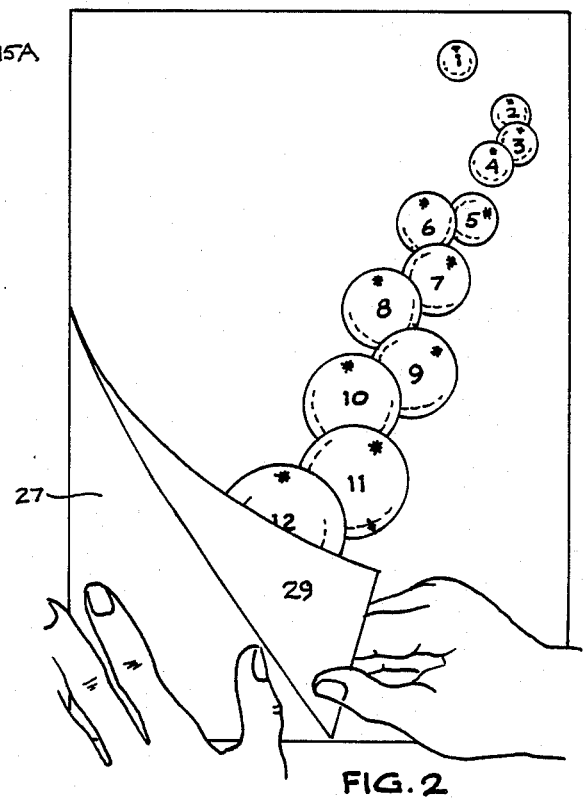
FIG. 2 is another view of FIG. 1 showing the film being separated from a release paper on which it is mounted.

It will be seen that in addition to the imprinting of the outlines of individual balloons 17*a*, the film 15 in FIGS. 1–5 is shown imprinted with dotted lines 20, arrows 22, and stars 24, the purpose of all of which will hereinafter be described. As seen from FIG. 2, the imprinted film 15 has a release paper 27 removably adhered to its back surface 29, whereby the release paper can be peeled therefrom as shown in FIG. 2.

Figure 3:
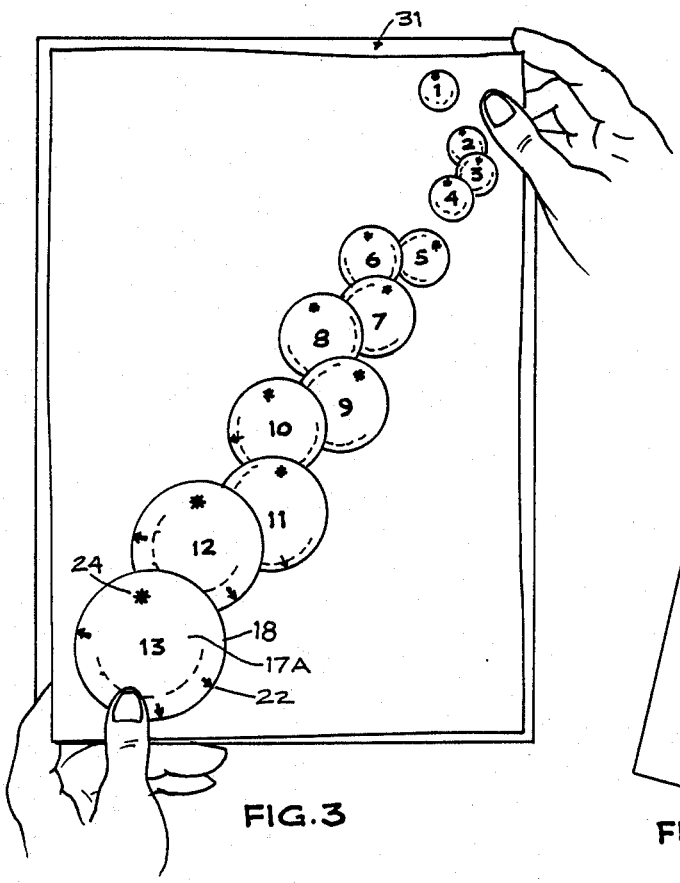
FIG. 3 is another view of FIG. 1 showing the positioning of the imprinted outlines of the balloons on a work surface which is to have the balloons pictured thereon.
Figure 6:
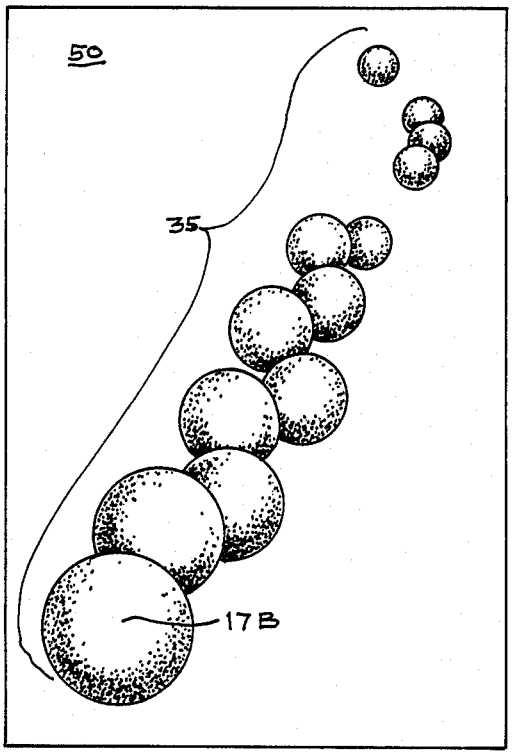
FIG. 6 shows the finished rendering of a series of balloons which has been produced using the article of this invention along with a process for applying pigment of different colors and varying intensities.

FIG. 3 shows the imprinted film 15 being placed so that when it is removably adhered to the work surface 31, it will be oriented in accordance with the desired position of the balloons 35 as they will finally be pictured as shown in FIG. 6.

Figure 4:
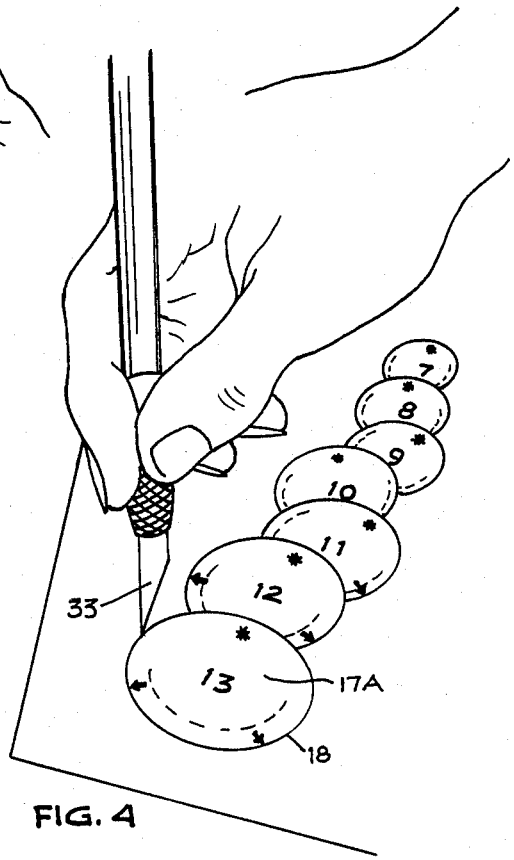
FIG. 4 is a perspective view of the imprinted film of FIG. 1 showing a balloon being scored with a sharp instrument so that it can be removed in appropriate sequence for application of pigment to the work surface underneath.

After the image outline 17 is oriented as shown in FIG. 3, FIG. 4 shows how one of the individual balloon sections 17*a* is carefully cut along the solid, dar line which constitutes its outline 18 by using a sharp blade 33 with pressure that is sufficient only to penetrate the film but not to cut the surface upon which the pigment will be applied. While the balloon bearing numeral "13", has been shown as being scored, it is noted that the process usually proceeds serially from the first balloon or first image, as indicated by the lowest numeral, down to the last, indicated by the highest numeral, which, in this case, is the balloon indicated by numeral "13".

Figure 5:
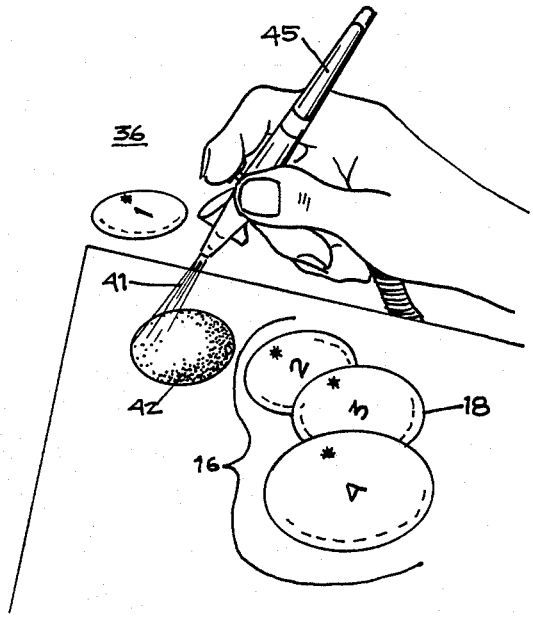
FIG. 5 is a perspective view showing a one-balloon size section of the outline, labeled with the numeral "1", having been removed and pigment being applied to the exposed work surface by means of an airbrush.

As seen from FIG. 5, which depicts the process in the usual numerical order, after the disk identified by numeral "1" 17*a*, has been scored, it is removed and placed aside for reference in the area 36 adjacent to the work surface 31. It should be noted that the remainder of the film 15, including the other imprinted sections 17*a*, as well as the surrounding areas 15*a*, which are transparent, remain attached to the work surface 31, thereby masking those areas of said surface from the inappropriate receipt of pigment as it is sprayed on the exposed area 42. Likewise, when the exposed area 42, shown in FIG. 5, is fully colored with pigment 41, using the professional rendering as a guide, and said pigment is dry, the section 17*a*, identified by the numeral "1" in FIG. 5, is replaced and re-adhered to the work surface 31 so that this now-completed area may be masked as the other areas, in their respective order, are exposed and sprayed according to the process of my invention.

Pigment is then applied, preferably as shown, with an airbrush 45, to the area of the work surface which has been expose by said removal. Using the professionally finished rendering (not shown) as a general guide, the user of my invention is aided, more particularly, by the dotted lines 20 and the stars 24 on removed balloon sections 17*a*, in the correct application of pigment. The dotted lines 20 show the area corresponding to the place on the work surface 31 which will receive a higher concentration of pigment—to effect shadowing and roundness; the star 24 shows the precise area, likewise corresponding to one on the work surface 31, where pigment will be sprayed to highlight the light source on the balloons.

While not depicted in all of the FIGS., arrows 22 appear on some of the individual balloon sections 17*a*, with the purpose, likewise as the dotted lines 20 and the stars 24, of giving specific guidance in the precise application of pigment, and in particular, the arrows 22 show the direction in which pigment should be sprayed.

FIG. 6 shows the work surface 31 filled in with the finished artwork 50 comprised of the individually colored sections 17*b* as produced by the use of my invention.

From the preceding description, it becomes apparent that a new and useful article and process for producing finished artwork for persons of varying skill levels have been described, wherein pigments are selectively applied to a surface. It can now be seen that the objects of this invention have been fulfilled.

It is, of course, understood that the description herein is by way of illustration, rather than limitation; the particular image and imprinting described above merely exemplify the basic process and article. As long as the placing, positioning and cutting of the film and application thereafter of pigment are in accordance with the imprinting on the film, the same kind of successful results can be obtained with a great variety of different images outlined on the film. Also, any combination of "instructions" can be provided on the film, in addition to the stars, dotted lines and arrows, to indicate to the artist how to achieve the finished end product of the process. It is still further understood that changes, modifications and various applications of this invention may be made without departing from the spirit and scope of the invention, especially as defined by the scope of the claims appended hereto.

What is claimed is:

1. A process for producing finished artwork wherein pigments are selectively applied to a surface using the placement, removal and replacement of an imprinted transparent film which is cut during said process, and wherein a previously-completed rendering of the desired finished end-product of said process is used as a guide for at least a portion of said selective pigment application comprising the steps of:

placing and removably adhering the imprinted film on said surface in an orientation in which the imprinted portion is disposed as an outline for the finished artwork which is to be produced, wherein said outline is subdivided into sections;

cutting said imprinted film along the imprinted outline whereby said sections can be selectively removed and replaced in their initial positions;

selectively removing cut sections of the film before applying pigment to the surface so that uncovered sections of the surface may receive pigment, while parts of the surface still bearing removed sections of the film are masked by said unremoved sections, thereby receiving no pigment;

applying pigment to the sections of the surface which have been exposed by the removal of cut sections of the film

2. A process, as set forth in claim 1, wherein the imprinting includes solid dark lines which serve as the denotations of the borders of the sections of the subdivided outline, and along which said sections can be cut out for removal and later replacement.

3. A process, as set forth in claim 1, wherein the sections of the subdivided outline of the image for the finished artwork which is to be produced have numerals imprinted thereon, with at least some sections bearing different numerals, and which sections are to removed serially, starting with all those bearing the lowest numeral, and proceeding in ascending numerical order.

4. A process, as set forth in claim 3, wherein after those sections bearing a certain numeral have been removed, pigment of a certain color is applied to the areas on the surface left exposed by said removal, which areas, when dry, are then recovered with their respective numbered pieces of film.

5. A process, as set forth in claim 1, wherein the imprinting includes dotted lines which denote areas of said sections to whcih pigment should be applied more heavily.

6. A process, as set forth in claim 1, wherein the imprinting includes arrows, whose purpose is to show the direction in which the pigment is to be applied when it is applied more heavily than in other areas.

7. A process, as set forth in claim 1, wherein the imprinted, transparent film is adherently attached to a backing sheet of release paper from which said film can be peeled away for placement on the surface upon which the finished artwork will be produced.

8. A process, as set forth in claim 7, wherein said imprinted film, once separated from its backing of release paper, is adherently applied to the surface so that it is laid out absolutely flat, with no wrinkles, bubbles or other indication that it is not completely smooth.

9. A process, as set forth in claim 1, wherein after said film has been smoothly and adherently applied to the surface, sections of the film, outlined in solid dark imprinting, are carefully cut along said outlines by using a sharp blade, with pressure sufficient only to penetrate the film, but not to cut into the surface upon which pigment will be applied.

10. A process, as set forth in claim 9, wherein the sections of the film which have been scored by a sharp blade are removed from the surface, leaving still attached the rest of said film, by carefully sliding the point of said blade under the corners of the portions of the film which are to be removed and by lifting said cut sections of film from said surface and placing them conveniently before the user of said process, for visual guidance in the production of the finished artwork.

11. A process, as set forth in claim 1, wherein the sections of the transparent film which have been removed guide the user of said process whereby numbers imprinted on said film are a key to the color of pigment which is to be applied to the areas of the surface which have been exposed by said removal, and wherein the removed pieces further aid the user in said process in that he is able to use symbols imprinted thereon to guide him in the precise direction and concentration of the application of said pigment.

12. A process, as set forth in claim 1, wherein after sections of imprinted transparent film which have been cut and removed and after pigment has been applied and said pigment has dried, the cut sections are replaced on to the surface, exactly in the area from which they were excised.

13. A process, as set forth in claim 1, wherein pigment in the form of ink or paint, is applied to the surface through an implement controlled by the user of said process, and with the aid of a device which uses compressed air as the propellant for the pigment, whereby fine droplets of the pigment are released from the implement and deposited in the form of a spray onto said surface.

14. A process, as set forth in claim 1, in which the finished artwork to be reproduced and whose outline is imprinted on the transparent film, is a series of spheres, representing balls or balloons, which is displayed in perspective, whereby the closest sphere to a viewer is the largest, and whereby the size of the spheres gradually decreases, with each sphere being depicted as a little smaller than the one in front of it, and wherein pigment is applied more concentratedly, and to a greater portion of the total area of each sphere, as the spheres decrease in size, and wherein each section of the imprinted film depicting an individual sphere is additionally imprinted with a star, denoting the precise area on the surface which, when exposed, will be applied with pigment to show a light source hitting the surface of that particular sphere, all of the foregoing helping to effect the qualities of roundness, shadow and perspective.

* * * * *

UNITED STATES PATENT AND TRADEMARK OFFICE

CERTIFICATE OF CORRECTION

PATENT NO. : 4,830,695

DATED : May 16, 1989

INVENTOR(S) : Raymond S. Shlemon

It is certified that error appears in the above-identified patent and that said Letters Patent is hereby corrected as shown below:

| | |
|---|---|
| Col. 3, line 5 | "dar", should be --dark--. |
| Col. 3, line 36 | "expose", should be --exposed--. |
| Col. 4, line 60, claim 5, | "whcih", should be --which--. |

Signed and Sealed this

Third Day of October, 1989

*Attest:*

DONALD J. QUIGG

*Attesting Officer*

*Commissioner of Patents and Trademarks*